US008783984B2

(12) United States Patent
Kim et al.

(10) Patent No.: US 8,783,984 B2
(45) Date of Patent: Jul. 22, 2014

(54) AUTO-CUTTER FOR ROLL PAPER PRINTER

(75) Inventors: Jin Tea Kim, Suwon-si (KR); Jin Kook Kim, Suwon-si (KR)

(73) Assignee: Bixolon Co., Ltd, Gyeonggi-do (KR)

( * ) Notice: Subject to any disclaimer, the term of this patent is extended or adjusted under 35 U.S.C. 154(b) by 623 days.

(21) Appl. No.: 12/582,121

(22) Filed: Oct. 20, 2009

(65) Prior Publication Data

US 2010/0239347 A1 Sep. 23, 2010

(30) Foreign Application Priority Data

Mar. 18, 2009 (KR) ..... 10-2009-0023113

(51) Int. Cl.

| | |
|---|---|
| ***B41J 11/00*** | (2006.01) |
| ***B41J 11/66*** | (2006.01) |
| ***B41J 3/407*** | (2006.01) |
| ***B41J 29/02*** | (2006.01) |

(52) U.S. Cl.

CPC ..... *B41J 3/4075* (2013.01); *B41J 11/66* (2013.01); *B41J 29/02* (2013.01)

USPC ..... 400/621.1; 400/621

(58) Field of Classification Search

CPC ..... B41J 11/70; B41J 11/703; B41J 11/706; B41J 11/66

USPC ..... 400/621, 621.1

See application file for complete search history.

(56) References Cited

U.S. PATENT DOCUMENTS

| | | | | |
|---|---|---|---|---|
| 6,030,135 | A * | 2/2000 | Imai | 400/621 |
| 2001/0000463 | A1* | 4/2001 | Kaya | 400/621 |
| 2007/0253759 | A1* | 11/2007 | Saito et al. | 400/621 |
| 2008/0069623 | A1* | 3/2008 | Kobayashi et al. | 400/621.1 |
| 2008/0199239 | A1* | 8/2008 | Kohira | 400/621 |

FOREIGN PATENT DOCUMENTS

| | | | |
|---|---|---|---|
| JP | 09-323292 | A | 12/1997 |
| JP | 11-000892 | A | 1/1999 |

OTHER PUBLICATIONS

Office Action issued by the State Intellectual Property Office of P.R. China, Jun. 5, 2013.

* cited by examiner

*Primary Examiner* — David Banh

(74) *Attorney, Agent, or Firm* — Gottlieb, Rackman & Reisman, P.C.

(57) ABSTRACT

Disclosed is an auto-cutter which is installed in a roll paper printer which prints a receipt, a barcode, a label or the like on paper and outputs it. The auto-cutter functions to automatically cut a section of roll paper off. A casing is provided in a main body of the roll paper printer. A step motor is installed in the casing and connected to a movable cutting blade through spur gears. Therefore, a paper cutter structure and a full and partial cut structure can be simplified. In particular, the present invention can prevent a cutter jam, thus enhancing reliability of the operation of cutting.

3 Claims, 7 Drawing Sheets

AUTO-CUTTER FOR ROLL PAPER PRINTER

CROSS REFERENCE TO RELATED APPLICATION

This application claims the benefit of Korean Patent Application No. 10-2009-0023113, filed Mar. 18, 2009, entitled "AUTO-CUTTER FOR MINI PRINTER", which is hereby incorporated by reference in its entirety into this application.

BACKGROUND OF THE INVENTION

1. Technical Field

The present invention relates generally to auto-cutters for roll paper printers and, more particularly, to an auto-cutter which automatically cuts a receipt, a barcode or a label which is printed and output by a roll paper printer.

2. Description of the Related Art

Generally, roll paper printers use roll paper as printing paper. As representative examples of the roll paper printers, there are a receipt printer which prints and outputs transactions between a consumer and a seller, a barcode printer which prints a barcode on paper and outputs it, and a label printer which prints a label on paper and outputs it. Typically, such a roll paper printer includes an auto-cutter which automatically cuts a printed section off from roll paper into a desired size.

In detail, the auto-cutter is installed in the roll paper printer and automatically cuts an output section off from roll paper. The section of the roll paper that is cut by the auto-cutter is used for the purpose of a receipt, a barcode, a label, etc.

To manufacture the auto-cutter, several critical techniques are used to form a paper cutter structure which implements a basic function of a cutter mechanism, a full and partial cut structure and a cutter jam prevention and removal structure. Furthermore, the auto-cutter has therein a motor to conduct the basic function of the cutter mechanism.

In the conventional techniques, a DC motor is typically used as the motor of the auto-cutter to implement the basic function of the cutter mechanism.

However, to fully or partially cut roll paper in such a way as to change the direction of rotation, the DC motor requires a separate device which is installed in the auto-cutter and varies an advancement distance (a stroke distance) of a cutting blade. Thus, the internal construction of the auto-cutter is complex.

Moreover, because the DC motor rotates in only one direction, a jam in which the roll paper is tangled with the cutting blade and is thus not output may occur in the process of cutting a section of the roll paper off. In particular, in the case of the auto-cutter using the DC motor, it is very difficult to remove the jam because of the structural characteristics of unidirectional rotation, thus reducing convenience of use of the auto-cutter and the reliability of the operation thereof.

SUMMARY OF THE INVENTION

The present invention has been made in an effort to solve a problem resulting from unidirectional rotation of a motor, the problem of a cutter jam occurring during a process of cutting roll paper, and the problem of a cutter jam not being able to be easily removed when one does occur.

In an auto-cutter for a roll paper printer according to an embodiment of the present invention, a casing has an installation space therein. A step motor having a drive shaft is installed in the casing in a vertical direction such that the drive shaft is oriented upwards. The step motor rotates by steps. A gear assembly comprises a plurality of spur gears engaging with each other. The spur gears are connected to the drive shaft of the step motor to rotate by steps in directions opposite to each other. A connection protrusion is provided at an eccentric position on a corresponding one of the spur gears. A movable plate has a guide slot formed eccentrically based on a center of the movable plate. The guide slot is fitted over the connection protrusion of the gear assembly. The movable plate is provided with a movable cutting blade to cut a roll paper in such a way as to move forwards or backwards under guidance of the guide slot.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, an embodiment of the present invention will be described in detail with reference to the attached drawings.

Figure 1:
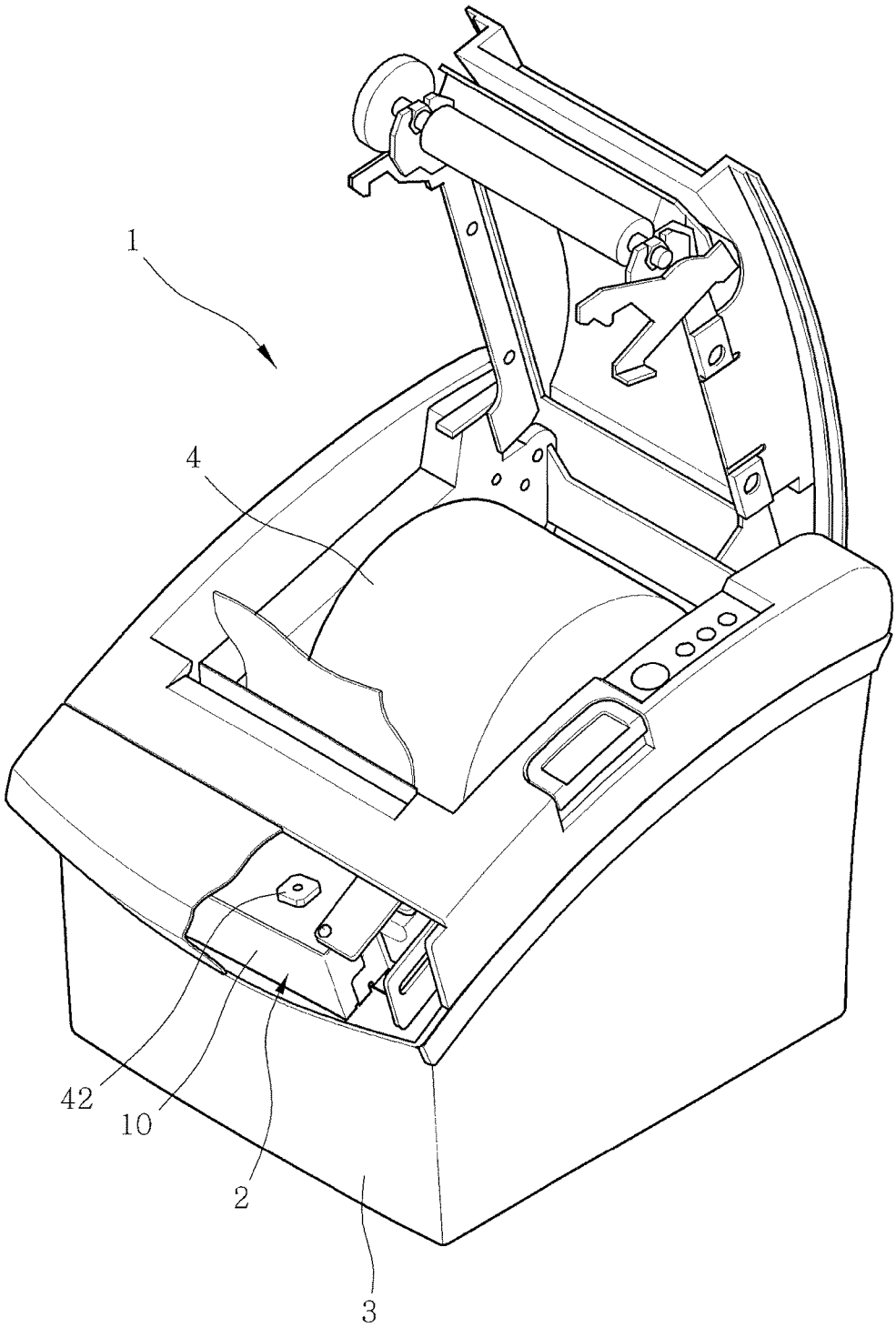
FIG. 1 is a perspective view of a roll paper printer having an auto-cutter, according to an embodiment of the present invention.

FIG. 1 is a perspective view of a roll paper printer 1 having an auto-cutter 2, according to the embodiment of the present invention. In detail, FIG. 1 illustrates the auto-cutter 2 installed in the roll paper printer 1 which prints an image on roll paper 4 and outputs it, the auto-cutter 2 cutting the printed section off from the roll paper 4.

Figure 2:
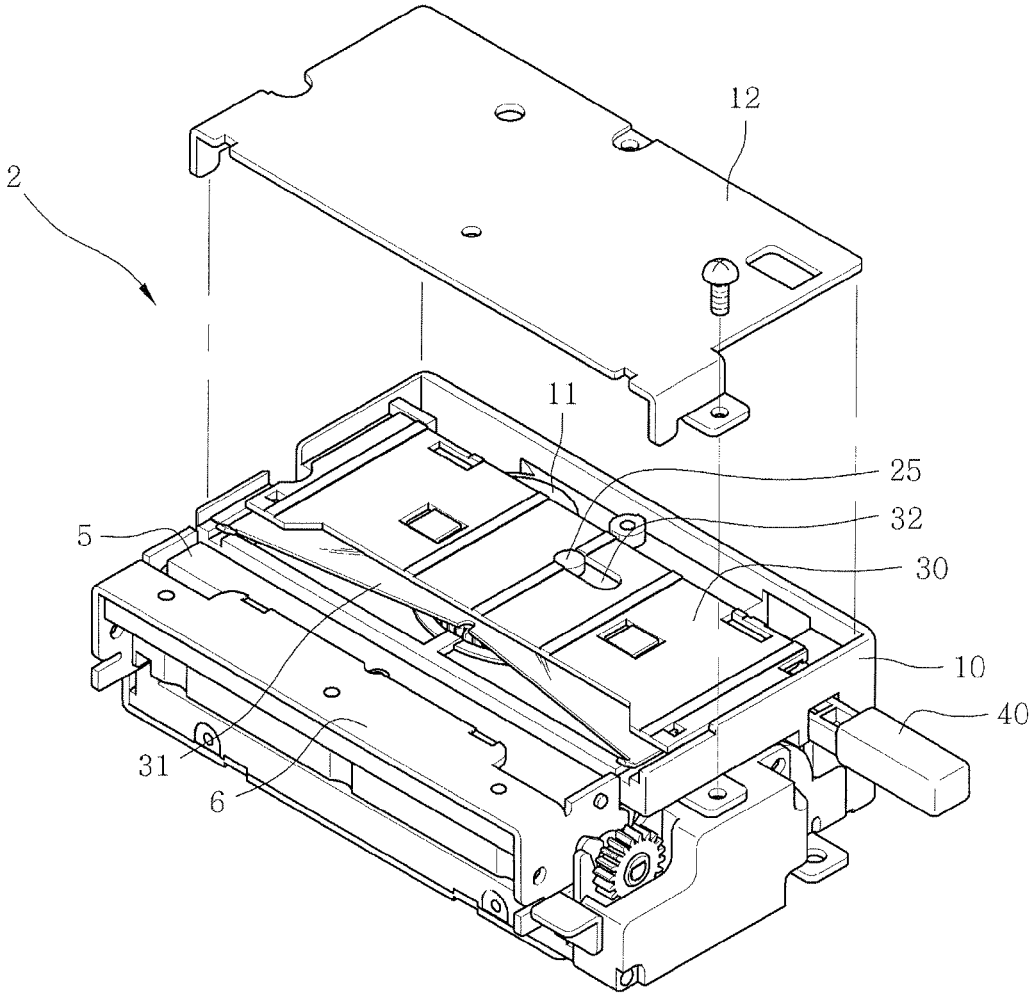
FIG. 2 is an exploded perspective view illustrating the auto-cutter according to the embodiment of the present invention.

FIG. 2 is an exploded perspective view illustrating the auto-cutter 2 according to the embodiment of the present invention. In detail, FIG. 2 shows the auto-cutter 2, from which an upper cover 12 is separated, to show the internal construction of the auto-cutter 2 which cuts the printed section off from the roll paper 4.

Figure 3:
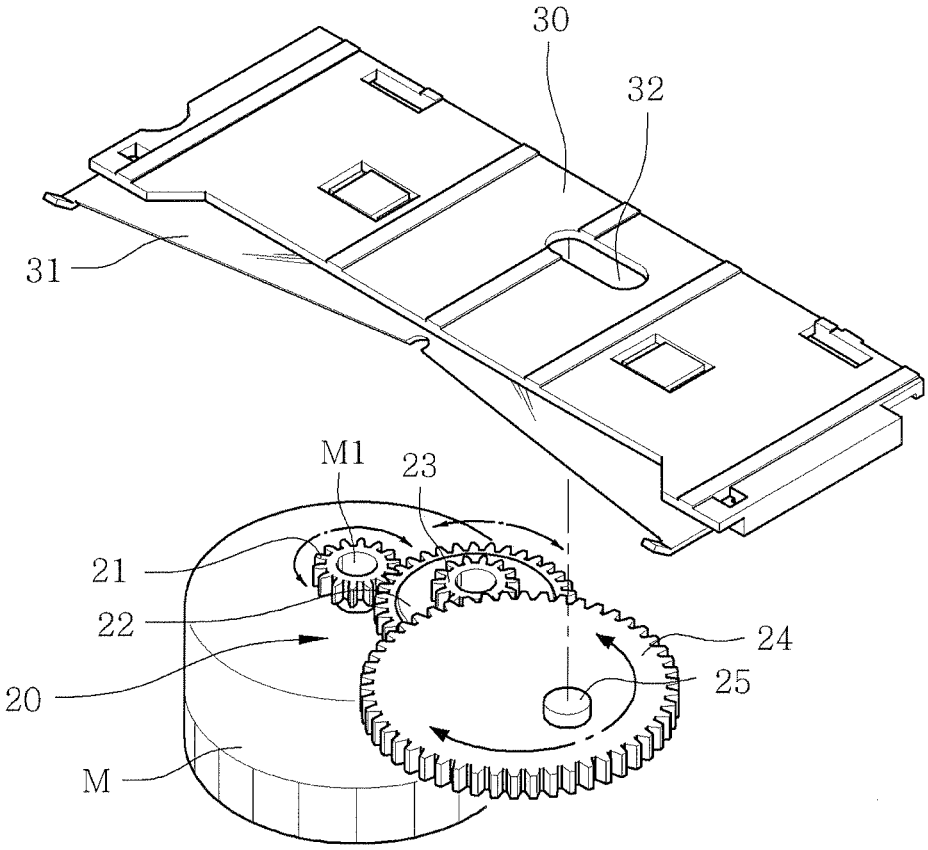
FIG. 3 is an exploded perspective view showing the coupling between a step motor, a gear assembly and a movable plate of the auto-cutter of FIG. 2.

FIG. 3 is an exploded perspective view showing the coupling between a step motor M, a gear assembly 20 and a movable plate 30 of the auto-cutter 2. The gear assembly 20 is connected to the step motor M which is disposed such that a drive shaft thereof is oriented upwards. The movable plate 30 having a movable cutting blade 31 is directly connected to a connection protrusion 25 which is provided at an eccentric position on the gear assembly 20.

Figure 4:
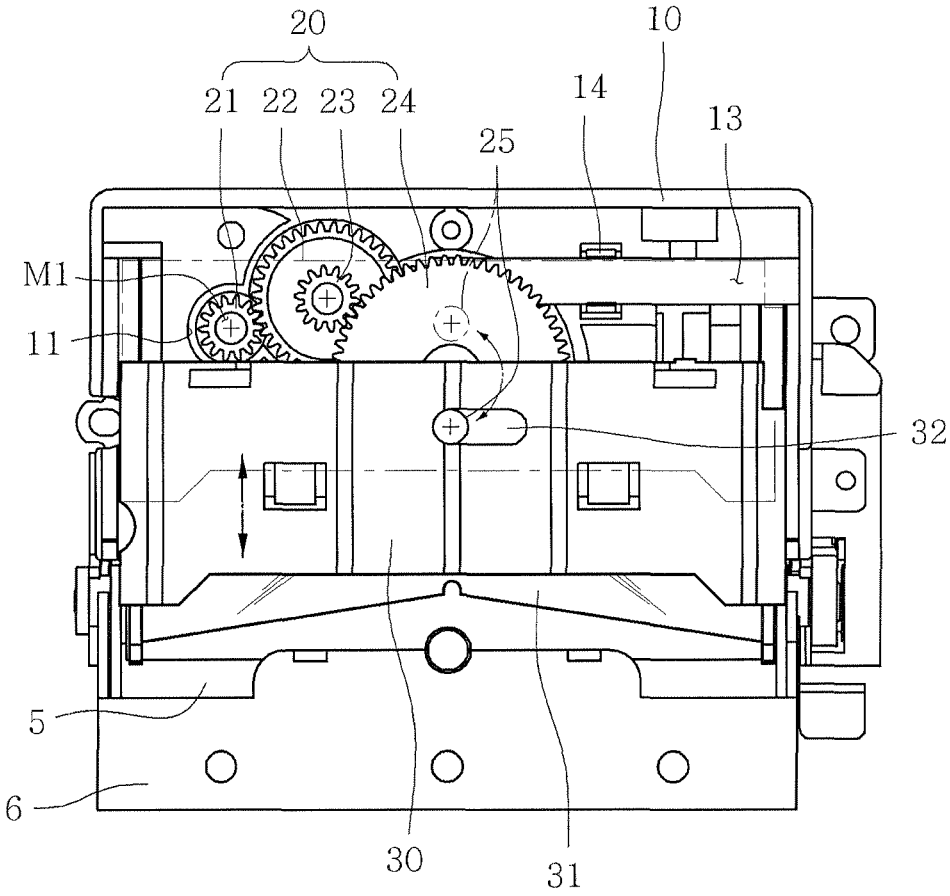
FIG. 4 is a plan view illustrating the operation of the auto-cutter according to the embodiment of the present invention.

FIG. 4 is a plan view illustrating the operation of the auto-cutter 2 according to the embodiment of the present invention. FIG. 4 shows the operation in which the gear assembly 20 is rotated by the step motor M and the movable plate 30 is moved forwards or backwards by the rotation of the gear assembly 20.

Figure 5:
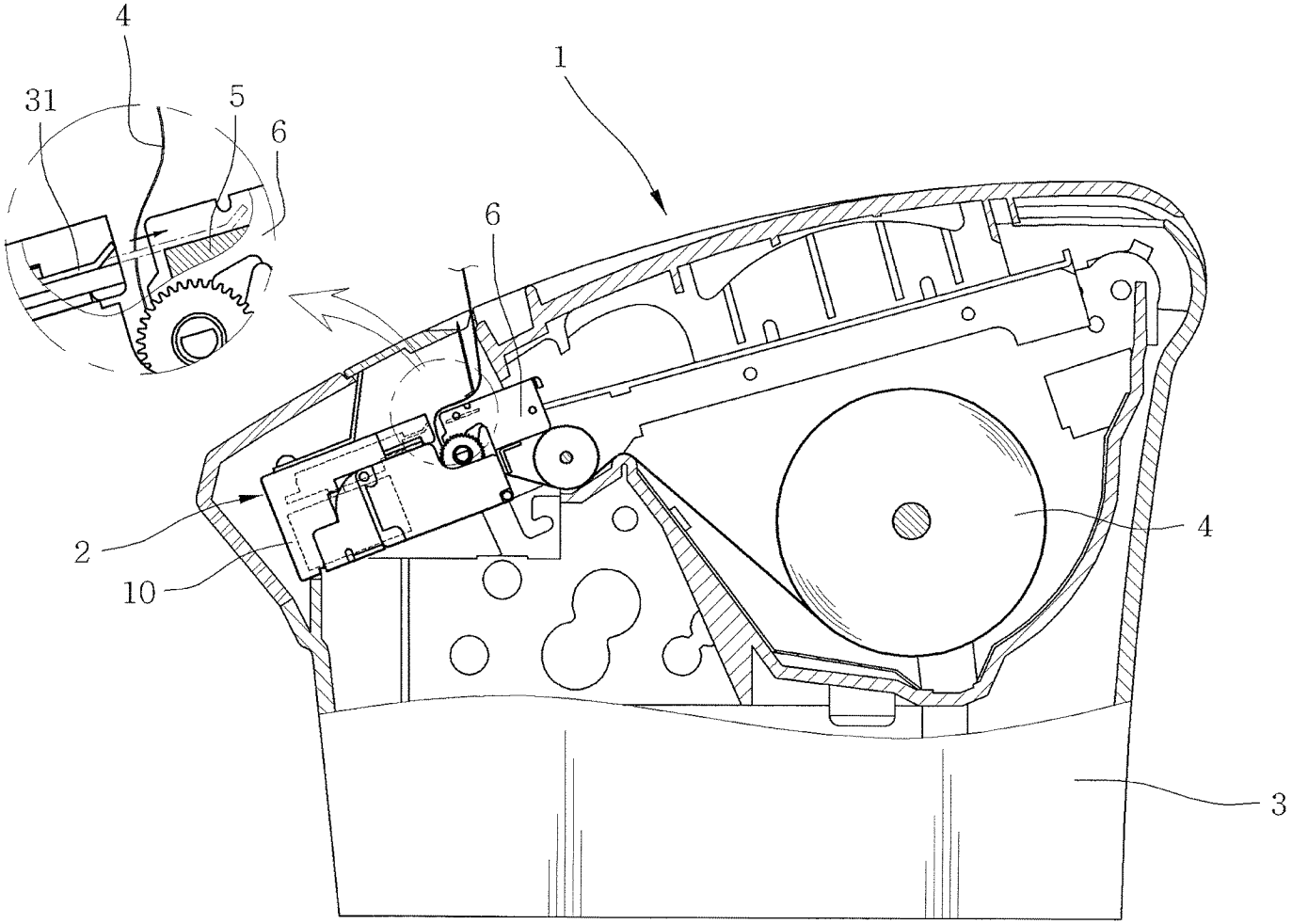
FIG. 5 is a partial sectional view of the roll paper printer which illustrates the use of the auto-cutter according to the embodiment of the present invention.

FIG. 5 is a partial sectional view of the roll paper printer 1 which illustrates the use of the auto-cutter 2 according to the embodiment of the present invention; FIG. 5 shows the operation of cutting the printed section off from the roll paper 4 using the auto-cutter 2 installed in the roll paper printer 1.

Figure 6:
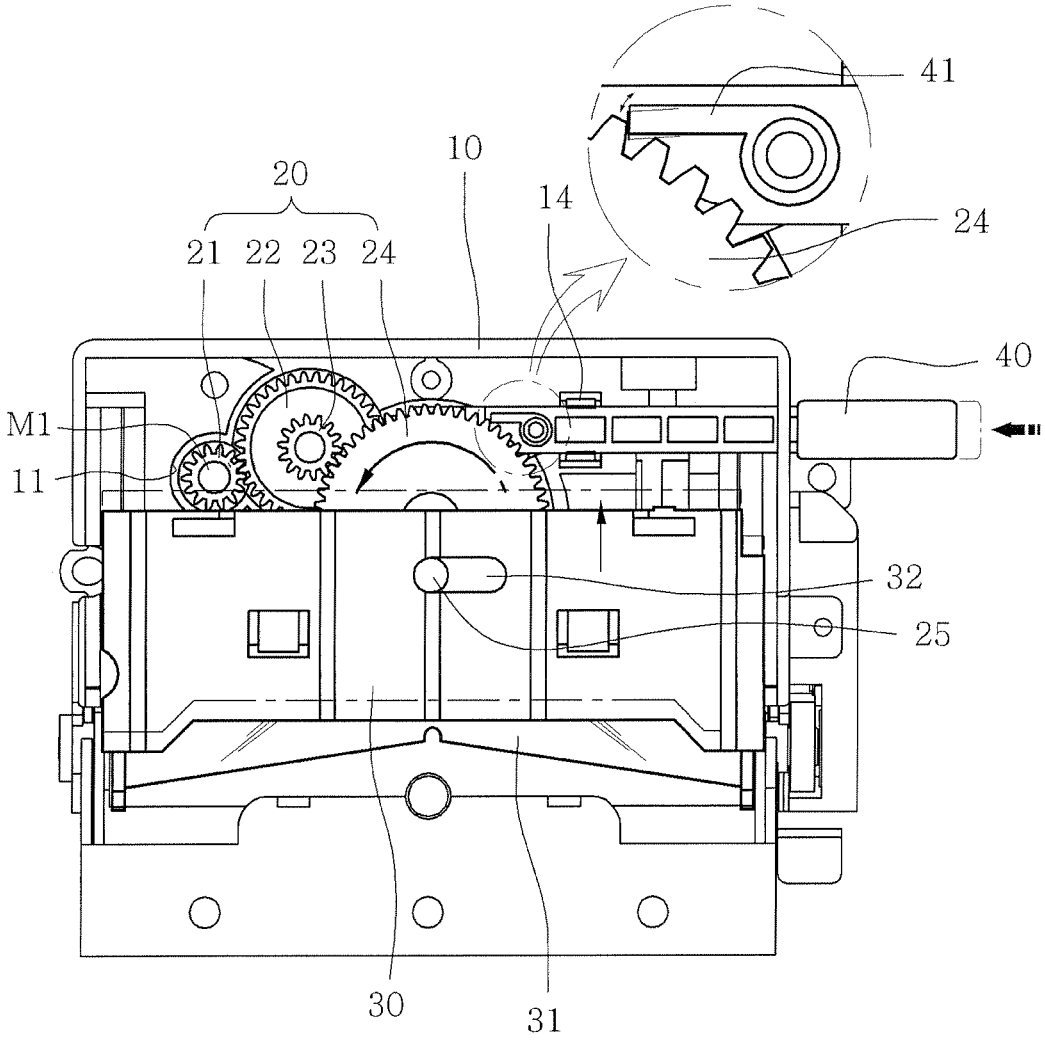
FIG. 6 is a plan view illustrating the operation of the auto-cutter when a push button is pushed according to the present invention.

FIG. 6 is a plan view illustrating the operation of the auto-cutter 2 when a push button 40 is pushed according to the present invention. That is, FIG. 6 illustrates the push button 40 which is provided in the auto-cutter 2 and which allows a user to manually rotate the gear assembly 20 connected to the step motor M.

Figure 7:
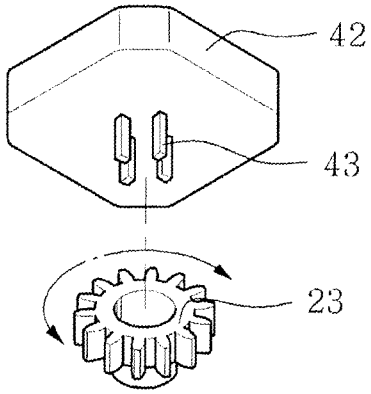
FIG. 7 is an exploded perspective view showing a manual rotary member according to the present invention.

FIG. 7 is an exploded perspective view showing a manual rotary member 42 according to the present invention. In other words, FIG. 7 shows the manual rotary member 42 which is coupled to the gear assembly 20 to allow a user to manually rotate the gear assembly 20.

In detail, as shown in FIGS. 1 through 4, the auto-cutter 2 for paper printers according to the embodiment of the present invention includes a casing 10 which is installed in a main body 3 of the roll paper printer 1, the step motor M, the gear assembly 20 and the movable plate 30 having the movable cutting blade 31.

The casing 10 forms the appearance of the auto-cutter 2 and is made of material having superior strength to prevent it from being deformed or damaged even if a large impact is applied thereto.

With regard to the installation position of the casing 10, it is typically fastened to the front surface of the main body 3 using a bracket and a bolt. Although this is illustrated in FIG. 1, it is only one example for illustrative purposes and the structure of the present invention is not limited to this.

The casing 10 defines therein an installation space 11 in which the step motor M and the gear assembly 20 constituting the auto-cutter 2 are installed. The installation space 11 can be changed depending on the shape of the step motor M or the gear assembly 20.

The casing 10 having the installation space 11 may selectively further include an upper cover 12 which protects the step motor M, the gear assembly 20 and the movable plate 30 having the movable cutting blade 31 and prevents them from being undesirably separated from each other. The upper cover 12 is shown in FIG. 2.

Furthermore, a frame 6 is installed in the casing 10. The frame 6 supports therein a stationary cutting blade 5 which is used to cut a section off from the roll paper 4 along with the movable cutting blade 31. The installation and operation of the frame 6 are techniques well known to those skilled in the art.

Meanwhile, the stop motor M is installed in the installation space 11 of the casing 10 and oriented in the vertical direction. The step motor M denotes a motor which is constructed such that the drive shaft M1 can be turned by a precise angle when current is applied to the motor.

For instance, the step motor M is set such that the drive shaft M1 is rotated by steps from 0° to 153°. Thereby, the movable plate 30 having the movable cutting blade 31 is moved forwards, in the case of a full cut, by about 10 mm, and by about 9 mm in the case of a partial cut, thus cutting the section printed and output by the roll paper printer 1 from the roll paper 4.

In the embodiment, the step motor M is disposed in the installation space 11 of the casing 10 in the vertical direction, so that the drive shaft M1 which rotates by steps when current is applied thereto is oriented upwards. The gear assembly 20 is connected to the drive shaft M1 to move the movable plate 30 having the movable cutting blade 31 forwards or backwards depending on the step-rotation of the drive shaft M1.

The gear assembly 20 includes well known spur gears which have gear teeth formed parallel with the drive shaft M1 of the step motor M and engage with each other.

The construction of the gear assembly 20 using the spur gears can have a precise ratio of rotation compared to that of the worm gear which has been used in the conventional DC motor, and thus is adapted to the structural characteristics of the present invention which require precise step-rotation. Furthermore, the gear assembly 20 using the spur gears can realize reverse rotation which has not been realized in the conventional worm gear mechanism. Moreover, the gear assembly 20 using the spur gears can simplify the structure thereof, thus enhancing the degree of freedom of space, compared to that of the combination of the rack and the pinion.

As shown in FIG. 3, in the gear assembly 20 of the embodiment, a first rotating gear 21 is fitted over the drive shaft M1 and is thus rotated by steps along with the drive shaft M1 in the same direction. A second rotating gear 22 engages with the first rotating gear 21 and thus rotates by steps in the direction opposite to the direction in which the first rotating gear 21 rotates.

Here, an auxiliary gear 23 is provided on the second rotating gear 22. Furthermore, a third gear 24 engages with the auxiliary gear 23 and thus rotates by steps in the direction opposite to the direction in which the second rotating gear 22 rotates. Ultimately, the third gear 24 moves the movable plate 30 having the movable cutting blade 31 forwards or backwards.

To couple the movable plate 20 to the gear assembly 20 having the above-mentioned construction, the connection protrusion 25 is eccentrically provided on the gear assembly 20 and is inserted into the movable plate 30. Due to this structure, the movable plate 30 can be moved forwards or backwards depending on the step-rotation of the gear assembly 20.

In the embodiment of the present invention, the connection protrusion 25 is provided on the upper surface of the third rotating gear 24.

As such, the gear assembly 20 is constructed by the combination of the spur gears and couples the step motor M to the movable plate 30. Thereby, as shown in FIG. 4, the movable cutting blade 31 which fully or partially cuts the roll paper 4 is moved forwards and backwards along with the movable plate 30. Because of such movement of the movable plate 30, the problem of a cutter jam in which the roll paper 4 gets stuck to the movable cutting blade 31 can be structurally prevented.

In detail, the movable cutting blade 31 which is mounted to the movable plate 30 is moved forwards or backwards by the step-rotation of the step motor M and the gear assembly 20 to cut the roll paper 4. Here, even if the roll paper 4 were not to be cut despite the movable cutting blade 31 having been moved forward, the movable cutting blade 31 is immediately moved backwards and returned to its original position, thus preventing a cutter jam.

The movable plate 30 is provided with the movable cutting blade 31 which substantially cuts the section of the roll paper 4 which is printed and output by the roll paper printer 1. The movable plate 30 is provided in the upper portion of the casing 10 and is directly connected to the connection protrusion 25 of the gear assembly 20. Thus, when the step motor M rotates, the movable plate 30 is moved forwards or backwards by the operation of the gear assembly 20.

The movable plate 30 has a guide slot 32 through which the connection protrusion 25 is directly connected to the movable plate 30. As shown in FIG. 4, the guide slot 32 is formed through the movable plate 30 at a portion eccentric to the right based on the center of the movable plate 30. The movable cutting blade 31 is mounted, preferably, under the movable plate 30 without interfering with the guide slot 32.

As such, the auto-cutter 2 according to the embodiment of the present invention realizes the cutter mechanism including the movable plate 30, the step motor M and the gear assembly 20. The auto-cutter 2 having the cutter mechanism is installed in the roll paper printer 1. Thereby, as shown in FIG. 5, the present invention improves the overall cutter mechanism, which not only includes the basic structure of the roll paper cutter which cuts the section of the roll paper 4 which is printed and output by the roll paper printer 1 to use it as a receipt, a barcode or a label, but also includes a full or partial cut structure and a jam prevention structure.

Meanwhile, in another embodiment of the present invention, the auto-cutter 2 further includes the push button 40 and the manual rotary member 42 to improve a cutter jam removal structure such that when a cutter jam occurs due to the power being unexpectedly shut off, the gear assembly 20 can be manually rotated by external force to remove a cutter jam.

The push button 40 is provided on the sidewall of the auto-cutter 2. When a cutter jam occurs, the user can push the push button 40 which protrudes outside the main body 3 of the roll paper printer 1, thus manually removing the cutter jam. A passage 13 is formed in the casing 10 and the push button 40 is installed in the casing 10 therethrough. The installation space 11 communicates with the outside through the passage 13.

The push button 40 is installed in the passage 13 of the casing 10 so as to be elastically movable using a spring (not shown) or the like. Therefore, when the user pushes three or four times the push button 40 protruding outside the casing 3, a front end 41 of the push button 40 pushes the third rotating gear 24 and rotates it in the reverse direction, thus moving the movable plate 30 backwards, as shown in FIG. 6. Hereby, the movable cutting blade 31 which has been tangled with the roll paper 4 is moved backwards, so that the cutter jam can be easily removed.

Here, in the auto-cutter 2 of the present invention using the step motor which rotates by steps, when the user pushes the push button 40 three or four times to reversely rotate the third rotating gear 24, the drive shaft M1 which has been rotated to move the movable plate 30 forwards is returned to 0°, that is, to its original position. Then, the movable plate 30 can no longer move, because the connection protrusion 25 of the gear assembly 20 is brought into contact with the end of the guide slot 32 of the movable plate 30. Therefore, the user can easily discern whether the movable cutting blade 31 has returned to its original position without having to open the roll paper printer 1, so that the present invention can enhance the convenience of using the roll paper printer 1.

Furthermore, a guide 14 is provided in the passage 13 to guide the push button 40. The guide 14 prevents the push button 40 from being removed from the passage 13 when it is operated, thus enhancing the reliability of the operation.

Meanwhile, in the auto-cutter 2 according to the present invention, the manual rotary member 42 is coupled to the upper end of the gear assembly 20 to allow the user to manually rotate the gear assembly 20. In this embodiment, as shown in FIG. 7, insert protrusions 43 are provided under the lower surface of the manual rotary member 42 and fitted into the upper end of the auxiliary gear 23.

Therefore, when a cutter jam occurs, the user partially opens the main body 3 of the roll paper printer 1 and then rotates the manual rotary member 42. Thereby, the auxiliary gear 23 is rotated in the direction in which the movable plate 30 is moved backwards. Hence, the movable cutting blade 31 which has been tangled with the roll paper 4 is moved backwards, so that the cutter jam can be easily removed.

In the present invention, the push button 40 and the manual rotary member 42 which remove the cutter jam by manually rotating the gear assembly 20 may be used together in the auto-cutter 2 or, alternatively, only either of them may be used.

As described above, in an auto-cutter for roll paper printers according to the present invention, a movable plate having a movable cutting blade is coupled to a step motor through a gear assembly which is constructed by a combination of spur gears. The movable cutting blade of the movable plate is moved forwards and backwards by the operation of the step motor, thus cutting a section off from the roll paper. Therefore, the cutter mechanism can be simplified, thus reducing the production cost of the auto-cutter, and markedly decreasing the incidence of malfunction. Thereby, the reliability of the operation of the auto-cutter can be enhanced.

Furthermore, when the movable cutting blade cuts the roll paper, the step motor is rotated by steps of an angle which is required to cut the roll paper, and is thereafter returned its original position by reverse rotation. Hence, the present invention can prevent a cutter jam in which the roll paper is stuck to the movable cutting blade or a stationary cutting blade.

Moreover, a push button or a manual rotary member is installed in the auto-cutter. Thus, the user can easily rotate the movable cutting blade manually. Therefore, even if problems occur, such as a cutter jam being caused by the power being unexpectedly shut off, or the problem of the movable cutting blade undesirably protruding while the user is manually handling the auto-cutter, the user can easily solve these problems by manually rotating the gear assembly using the push button or the manual rotary member.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An auto-cutter for a roll paper printer, that comprises:

a casing having an installation space therein;

a step motor having a drive shaft and installed in the casing in a vertical direction such that the drive shaft is oriented upwards, the drive shaft rotating in clockwise and counterclockwise directions by steps;

a gear assembly comprising a plurality of spur gears engaging with each other, the spur gears being connected to the drive shaft of the step motor, and a connection protrusion provided at an eccentric position on the upper surface of the spur gears in order to rotate in clockwise and counterclockwise directions by steps; and a movable plate having a guide slot formed eccentrically based on a center of the movable plate, and being provided with a movable cutting blade to cut a roll paper in such a way as to move forward or backward depending on the clockwise and counterclockwise rotation of the connection protrusion, wherein the gear assembly comprises a first rotating gear connected to the drive shaft of the step motor;

a second rotating gear engaging with the first rotating gear and rotating by steps in a direction opposite to a direction in which the first rotating gear rotates, with an auxiliary gear provided on an upper surface of the second rotating gear; and a third rotating gear engaging with the second rotating gear and rotating by steps in a direction opposite to the direction in which the second rotating gear rotates, with the connection protrusion provided at the eccentric position on an upper surface of the third rotating gear, and, further, wherein the drive shaft rotates in one direction at a predetermined angle and has the movable cutting blade move forward, and the drive shaft also rotates in the opposite direction at a predetermined angle, and has the movable cutting blade move backward so that the cutter jam can be prevented.

2. The auto-cutter as set forth in claim 1, wherein a passage is formed in the casing, the passage communicating the installation space with an outside, and a push button is installed in the passage so as to be elastically movable, wherein the auto-cutter includes a manual rotary member coupled to the gear assembly to allow thereof to be manually operated.

3. The auto-cutter as set forth in claim 2, wherein the gear assembly is manually rotated by operation of the push button, and wherein said manual rotary member coupled with the upper surface of the auxiliary gear to manually rotate the auxiliary gear, and a insert protrusion coupled with the upper surface of the auxiliary gear are formed on the lower surface of the manual rotary member.

* * * * *